US009710008B2

(12) United States Patent
Svorc

(10) Patent No.: US 9,710,008 B2
(45) Date of Patent: Jul. 18, 2017

(54) FAST BIAS CURRENT STARTUP WITH FEEDBACK

(71) Applicant: Dialog Semiconductor (UK) Limited, Reading (GB)

(72) Inventor: Jindrich Svorc, Swindon (GB)

(73) Assignee: Dialog Semiconductor (UK) Limited, Reading (GB)

( * ) Notice: Subject to any disclaimer, the term of this patent is extended or adjusted under 35 U.S.C. 154(b) by 217 days.

(21) Appl. No.: 14/550,925

(22) Filed: Nov. 22, 2014

(65) Prior Publication Data

US 2016/0147246 A1 May 26, 2016

(30) Foreign Application Priority Data

Nov. 20, 2014 (EP) ..... 14194212

(51) Int. Cl.
*G05F 3/26* (2006.01)

(52) U.S. Cl.
CPC ..... *G05F 3/26* (2013.01); *G05F 3/262* (2013.01)

(58) Field of Classification Search
CPC ..... G05F 1/561; G05F 1/567; G05F 1/569; G05F 1/571; G05F 1/573; G05F 1/5735; G05F 1/153; G05F 1/08; G05F 1/26; G05F 1/34; G05F 1/16; G05F 1/62; G05F 1/66; G05F 1/575; G05F 1/577; G05F 1/585; G05F 1/59; G05F 1/595; G05F 1/607; G05F 1/61; G05F 1/613; G05F 1/614; G05F 1/618; G05F 1/468; G05F 3/24; G05F 3/262; G05F 3/26; G05F 3/265; G05F 3/00; G05F 3/08; G05F 3/10; G05F 3/16;
(Continued)

(56) References Cited

U.S. PATENT DOCUMENTS 7,208,927 B1 * 4/2007 Nguyen ..... G05F 1/468 323/282
8,283,974 B2 10/2012 Chu et al.
(Continued)

FOREIGN PATENT DOCUMENTS

EP 0 994 403 4/2000
GB 2475624 5/2011

OTHER PUBLICATIONS

European Search Report, 14194212.8-1807, Jun. 9, 2015, Dialog Semiconductor (UK) Ltd.
(Continued)

*Primary Examiner* — Harry Behm
*Assistant Examiner* — Bryan R Perez
(74) *Attorney, Agent, or Firm* — Saile Ackerman LLC; Stephen B. Ackerman

(57) ABSTRACT

A current mirror circuit comprising an input driver connected to a plurality of output driver circuits through a current mirror network. The current mirror network is separated into two parts, wherein the first part comprises the input driver circuit and the second part comprises capacitive loads including a filter capacitor. A switch separates the two parts where an amplifier senses the first part and controls the second part to track the first part when the current mirror circuit is activated. The low source resistance of the output of the amplifier facilitates a fast charging of the capacitance of the second part of the current mirror network dramatically improving signal delay and transition time.

15 Claims, 4 Drawing Sheets

(58) Field of Classification Search
CPC . G05F 3/18; G05F 3/185; G05F 3/227; G05F 3/247
USPC ..... 327/530, 543, 538, 53
See application file for complete search history.

(56) References Cited

U.S. PATENT DOCUMENTS

| | | | | |
|---|---|---|---|---|
| 2004/0113706 | A1 | 6/2004 | Yen et al. | |
| 2004/0263261 | A1* | 12/2004 | Dosho | H03H 7/06 331/17 |
| 2005/0134344 | A1 | 6/2005 | Ro | |
| 2008/0143429 | A1 | 6/2008 | Mizuki et al. | |
| 2009/0085654 | A1* | 4/2009 | Lin | G05F 3/205 327/543 |
| 2011/0274290 | A1 | 11/2011 | Holzmann et al. | |
| 2012/0007660 | A1 | 1/2012 | Hummerston et al. | |
| 2013/0033104 | A1 | 2/2013 | Gunther et al. | |
| 2014/0312963 | A1* | 10/2014 | Berkhout | G05F 3/262 327/543 |

OTHER PUBLICATIONS

Co-pending US Patent DS13-081, U.S. Appl. No. 14/550,924, filed Nov. 22, 2014, "Fast Start-up Circuit for Low Power Current Mirror," by Jindrich Svorc, 15 pgs.

* cited by examiner

FAST BIAS CURRENT STARTUP WITH FEEDBACK

RELATED PATENT APPLICATION

This application is related to U.S. patent application Ser. No. 14/550,924, filed on Nov. 22, 2014, and assigned to the same assignee as the present invention, and which is herein incorporated by reference in its entirety.

TECHNICAL FIELD

The present disclosure is directed to a fast start-up circuit, in particular for a low power current mirror.

BACKGROUND

In general every analog block within an integrated circuit needs a current bias to allow for proper operation. A main current bias distribution within a chip can be a current source that is distributed with in an integrated circuit chip by means of a few current mirror circuits. The bias current circuit causes additional power consumption.

Because the bias current circuit is additional power consumption for the chip, the actual used value is small, especially in very low power design, which can be down to a few tenths of a nano-amp. Such a small current is prone to being disturbed by other circuitry on the chip and sometimes by the biased block itself. In order to filter such a noise disturbance, a simple low pass filter usually created by a normal capacitor or MOS capacitor is added.

US 2013/0033104 A1 (Gunther et al.) is directed to a system that includes a start-up circuit that compares a feedback voltage to an output voltage. US 2011/0274290 A1 (Holzmann et al.) is directed to a driver device with a bias circuit that includes a buffer for rapidly charging an external capacitance. US 2005/0134344 A1 (Ro) is directed to a method and a system to provide a fast start-up circuit for a pre-scaler device. US 2004/0113706 A1 (Yen et al.) is directed to a fast start-up oscillator, which provide a fast stabilized voltage source. U.S. Pat. No. 8,283,974 B2 (Chu et al.) is directed to a fast start-up low voltage bandgap reference voltage generator.

In FIG. 1 is shown a bias circuit of prior art, wherein a main current bias, Ibias, is distributed by means of current mirrors like N1 and Nx. Since the bias current is additional power consumption, the actual amount used is reasonably small, especially in very low power design that can be down to few tenths of nano-amps. These small current amounts are prone to be disturbed by other circuitry on the chip, which can be sometimes disturbed by the biased block itself. A simple low pass filter, usually created by a normal capacitor or MOS capacitor is added to filter noise and disturbance from other circuitry. This capacitor might be also created by the input gate capacitance of all the mirror transistors which are connected to the nbias node so it disappears from the schematic, but it is still present. It is depicted in FIG. 1 as C1. This low pass filter filters the nbias node voltage and makes the currents Ibias_2 and. Ibias_x less noisy.

Using capacitance C1 to filter noise has a drawback, which is long start-up time of the circuit. When the block is disabled, the disable switch S2 is ON and enable switch S1 is OFF. This means the nbias voltage is 0V, and voltage at nswitch is equal to Vdd. When the current bias is enabled, the disable switch S2 is turned OFF and enable switch S1 is turned ON. Bias current starts flowing from drain of P2, which starts the charging of C1. At that moment no current is flowing through Ibias_2 through Ibias_x branches. The voltage in nbias is increasing as C1 is being charged and finally at the moment when the nbias reaches threshold voltage of the transistor Nx, the current in the branches 'Ibias_x' starts flowing. It takes even a longer time until the current in the Ibias_x branch is fully settled.

FIG. 2 shows waveforms at key locations in the circuit of FIG. 1. As switch S1 is closed, switch S2 is opened, causing voltage at node nswitch to fall to ground before recovering to nbias that is between Vdd and 0V. The current Ibias 2 is somewhat delayed beyond the start of nbias until the gate of the N2 transistor is brought up to a threshold voltage.

SUMMARY

It is an objective of the present disclosure to speedup current bias for analog blocks within an integrated circuit.

It is also and objective of the present disclosure to speedup the signal transition times of the current signals.

It is further an objective of the present disclosure to charge current mirror capacitance with a low impedance source to improve circuit rise time within the current mirror circuit.

The current mirror circuit of the prior art comprises an input driver, designated as N1, and a plurality of output driver transistors designated as N2 to Nx in FIG. 1. The current mirror network designated as nbias distributes gate bias in the current mirror circuit to the output driver transistors in a low current environment, wherein the output driver transistors in FIG. 1 supplies current to a logic block of circuits that is slow as a result of circuit capacitance, which includes gate capacitance, filter capacitance and parasitic capacitance, and which is charged with a relatively low current source having a relatively high source impedance. This results in a long transition time and adds significantly to a slow startup current startup.

A first embodiment of the present disclosure dramatically improves the signal delay of the circuitry shown in FIG. 1 of the prior art. This is accomplished by separating the nbias network of the current mirror circuit into two parts, wherein the first part of the nbias network contains only the input driver of the current mirror circuit, and the second part contains the input gates of the plurality of output drivers including the filter capacitor. An amplifier is used to monitor the first part of the nbias network and control the second part of the nbias network to track the first part as the current mirror circuit is powered on. The low impedance of the output of the amplifier allows the second part of the current mirror circuit to charge quickly matching the turn on of the first part of the current mirror circuit. A comparator circuit compares a reference current with an output current of the current mirror circuit and when the comparator circuit is tripped, an RS flip flop is set, which disconnects the amplifier and reconnects the first and second parts of the current mirror. The reconnection of the two parts of the current mirror circuit is a smooth operation since the amplifier had been controlling the second part of the current to track the first part of the current mirror circuit.

In a second embodiment two NMOS transistors comprise the amplifier of the first embodiment and the RS flip flop which is created by a switch and the current comparator. The switch is driven by the output of the comparator circuit. When the output current reaches a threshold current, the switch that forms part of the RS flip flop with the current comparator turns off the switch, which latches the output of the comparator because the input to the comparator is held down by a transistor in the current mirror circuit. At the same time the amplifier is disabled and the two parts of the current mirror circuit are rejoined.

BRIEF DESCRIPTION OF THE DRAWINGS

This invention will be described with reference to the accompanying drawings, wherein.

DETAILED DESCRIPTION

Figure 3:
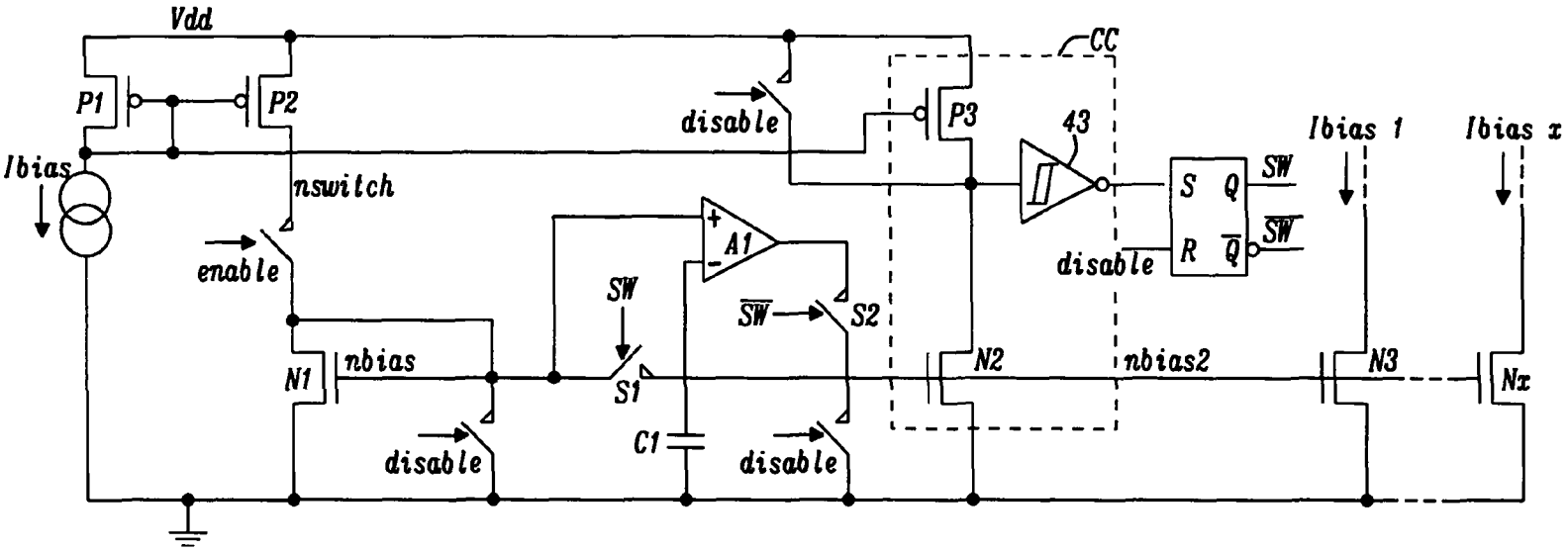
FIG. 3 is a current mirror circuit of the first embodiment of the present disclosure.

In FIG. 3 is shown a schematic of the first embodiment of the present disclosure. A source current mirror circuit comprising transistors P1, P2 and P3 distributes Ibias to the main current mirror circuit comprising N1, N2 and N3 to Nx, wherein N3 to Nx are current mirror driver circuits to provide load current, Ibias_1 to Ibias_X, to circuits on an integrated circuit device, and wherein N2 is a driver circuit that provides current to a comparator circuit. The comparator circuit drives an RS flip-flop to control switches S1 and S2, Switch S1 separates the current mirror network into two parts nbias and nbias2 and switch S2 connects the output of the amplifier A1 to nbias2. The positive input to the amplifier A1 is connected to nbias and the negative input to the amplifier is connected to nbias2. This allows amplifier A1 to track the voltage of the first part of the current mirror network, nbias, and control the second part of the current mirror circuit, nbias2, to follow the first part by driving the capacitance of the second part with the low output resistance of amplifier A1. Therefore, the first part of the current mirror network charges relatively quickly because there is very little capacitance to charge. At the same time the second part of the current mirror network, nbias2, closely tracks the first part because the capacitance of the second part of the current mirror network (C1 and the parasitic capacitance of drivers N2, and N3 through Nx) is being charged by a low impedance output of the amplifier A1.

As the capacitance connected to the second part of the current mirror network is charged by amplifier A1, transistor N2 provide a current to the comparator circuit CC and compared to current from transistor P3 that is part of a bias current mirror circuit. When the current level from N2, which is equal to current from P3, which is equal to Ibias, the comparator triggers the RS flip-flop to close Switch S1 and open switch S2. Thus the current mirror quickly comes to full scale operation because the amplifier controlled the second part of the current mirror network nbias2 to follow the voltage of the first part nbias and the output of the amplifier A1 charged the capacitance of the second part with a low impedance output.

Figure 1:
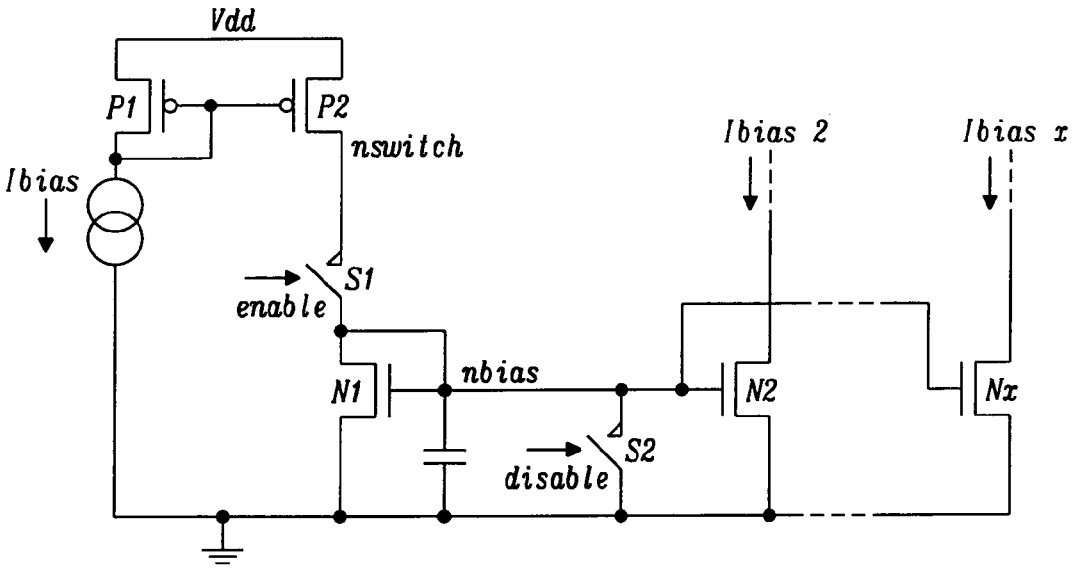
FIG. 1 Prior Art
FIG. 1 is a circuit diagram of a current mirror circuit of prior art.
Figure 2:
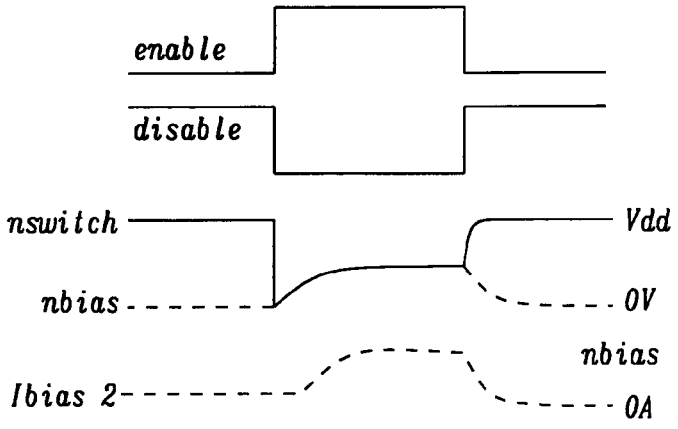
FIG. 2 Prior Art
FIG. 2 is a set of waveforms associated with the prior art current mirror circuit of FIG. 1.

The current mirror circuit shown in FIG. 1 produces huge delay when the block is enabled since the input bias current needs to charge the parasitic capacitance of the input transistor, the base of all the transistors in the current mirror and the filtering capacitance tied to the gate node. The proposed solution acts differently in the enabling stage. In this stage the switch S1 is open and input transistor is not connected to the rest of the current mirror. It means the bias current is charging the parasitic capacitance of the input transistor only. The amplifier keeps the gate voltage of the rest of the current mirror at the same potential as the input transistor but since the output impedance of the amplifier is much lower than the output impedance of the current bias the net nbias2 follows net nbias.

Combination of two transistors P3 and N2 create current comparator which compares the reference current derived from the Ibias via P3 with the output current from N2. At the moment when the comparator trips the RS flip-flop is set and switches S1 and S2 controlled from the output of the RS flip-flop to disconnect the output of the amplifier and short the nets nbias and nbias2 together. In the other words the amplifier is charging net nbias2 to the correct potential and then re-connects the nbias2 network to the nbias network and the circuit works as simple current mirror.

It should be noted that in FIG. 3 that there are a number of switches denoted with either 'enable' or 'disable'. The switches do not affect on the operation of the circuitry as noted above as long their open/closed status is not changed from that shown in FIG. 3. The purpose of these switches is to disable, or enable, the current mirror circuitry.

Figure 4:
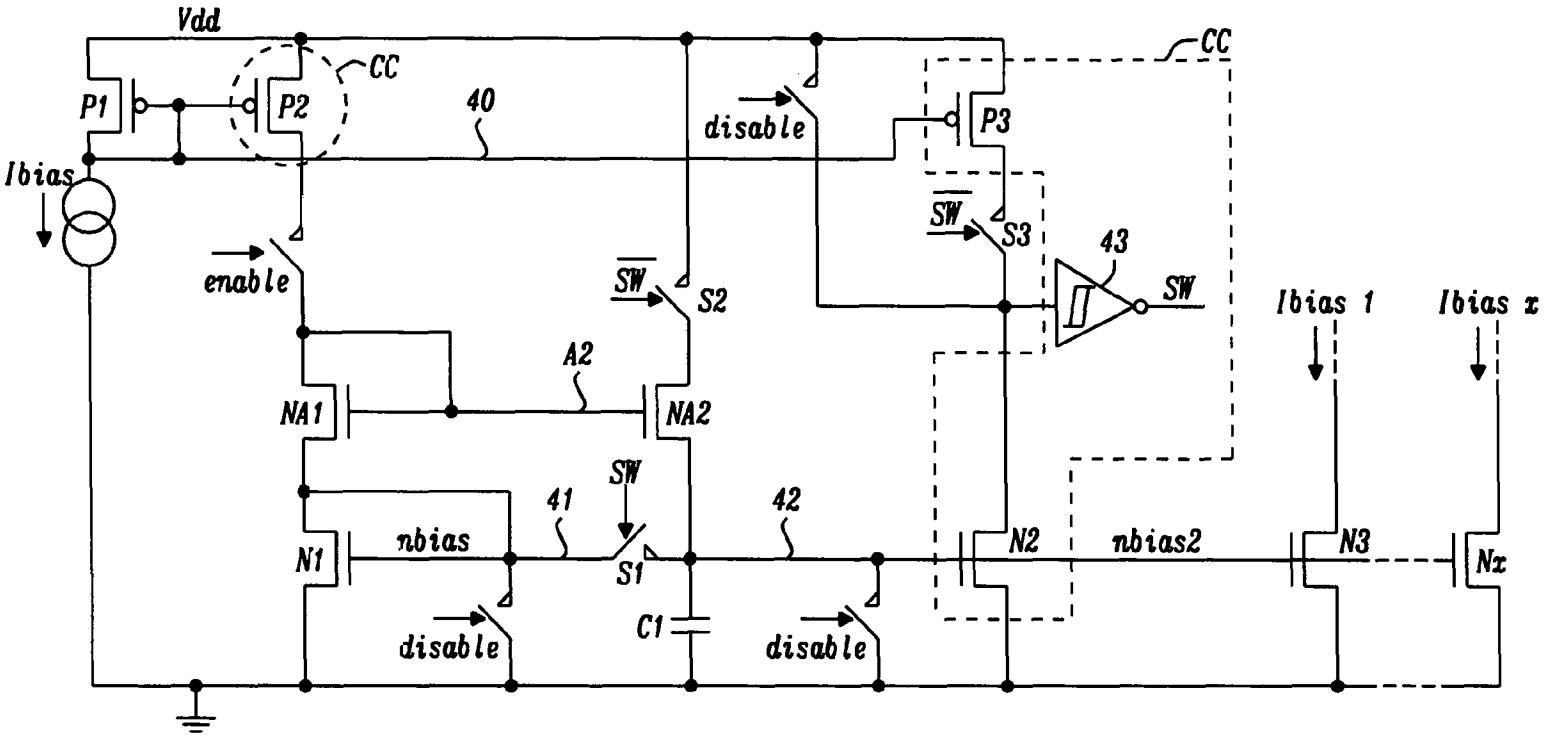
FIG. 4 is a current mirror circuit of the second embodiment of the present disclosure.

In FIG. 4 is shown a second embodiment of the present disclosure. The circuitry of the second embodiment is basically the same as shown in FIG. 3 with the exception of the detail implementation of the amplifier A2 and the comparator circuitry 43. The amplifier A2 comprises transistors NA1 and NA2, wherein transistor NA1 is connected to a current source network output transistor P2, wherein transistor P2 forms a part of a current mirror circuit 40 that provides input source current to the main current mirror circuit comprising N1 and network parts nbias 41 and nbias2 42. The amplifier A2 is connected to the first part of the main current mirror network nbias through a connection to P2, and the output of the amplifier is connected to the second part of the current mirror network nbias2, wherein the source of transistor NA2 connects to nbias2 providing a low output source impedance. Switch S2 when opened disconnects the amplifier A2 from providing any further energy to operating the fast start up circuit.

When the circuit of FIG. 4 is first started up, switch S1 is opened forming a first part of the current mirror circuit comprising N1 connected to nbias and a second part comprising nbias2 to which is connected the gate capacitance of a plurality of transistor gates and a filter capacitor C1. Thus the second part of the current mirror network is separated into low capacitance (part 1) and high capacitance (part 2). The low source impedance of the output transistor NA2 of amplifier A2 is used to drive the high capacitance of the second part of the current mirror network nbias2. Thus the amplifier A2 detects the bring-up voltage of the first part of the current mirror network and controls the second part of the current mirror network to quickly follow the bring-up voltage of the first part, and when the two parts are brought back together there will not be any affects from the voltage on nbias and nbias2 since they are the same.

Transistor N2 provides a current from the second part of the current mirror network as the amplifier A2 powers up the second part of the network, and P3 provides a target current from the current mirror source comprising P1, P2 and P3. When the current from N2 equals the current from P3 at the input node cc of the current comparator, control signal SW turns off switch S3 which latches the output of the comparator since the input node CC of the comparator is held down by transistor N2. At the same time the amplifier is disabled by the opening of S2 and S1 is closed to reconnect nbias to nbias2.

Figure 5:
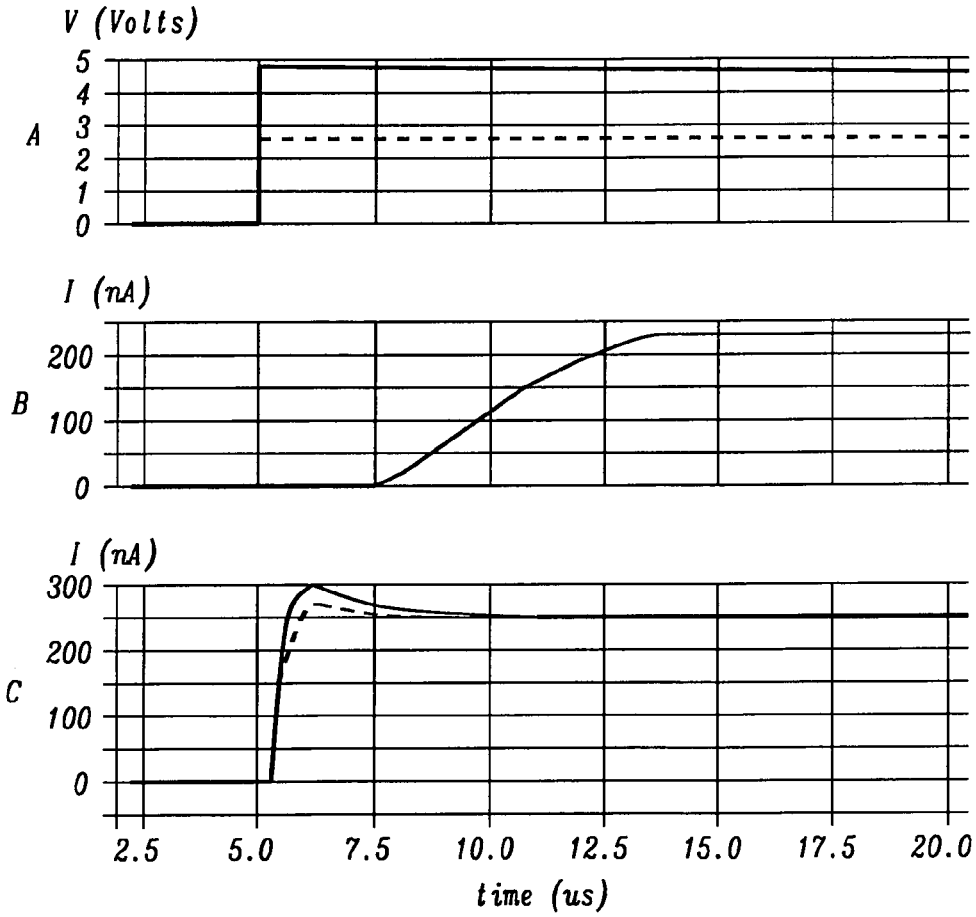
FIG. 5 is diagram of the performance improvement of the present disclosure.

FIG. 5 demonstrates the performance improvement caused by the circuit improvements of FIG. 3 and FIG. 4. FIG. 5A shows the input voltage where the solid and dashed line are two different voltage levels. FIG. 5B shows the response of the current mirror to a step function, and FIG. 5C the response of the circuit of FIG. 3 and FIG. 4 to the step function FIG. 5A. It is clearly seen that both delay and rise time are dramatically improved.

It should be noted that although the shown solution comprises a NMOS current mirror, similar performance improvement can be accomplished for a PMOS current mirror.

While the invention has been particularly shown and described with reference to preferred embodiments thereof, it will be understood by those skilled in the art that various changes in form and details may be made without departing from the spirit and scope of the invention.

What is claimed is:

1. A fast start-up power circuit, comprising:

a) a current source configured to provide current to the start-up circuit;

b) a current mirror circuit configured to receive current from said current source, wherein a first transistor of the current mirror circuit is directly connected to the current source, a second transistor of the current mirror circuit provides current via an enable switch to a first terminal of an transistor of an input driver circuit and a third transistor of the current mirror circuit provides a reference current;

c) said input driver circuit, configured to control a current mirror network, comprising said transistor of the input driver circuit, wherein a gate of said transistor is directly connected to the first terminal of said transistor and a second terminal of said transistor is connected to ground, said enable switch, an amplifier, configured to keep a gate voltage of the current mirror network at the same potential as a gate voltage of said transistor until the start-up phase is completed, while both gate voltages are connected only via the amplifier during start-up phase, wherein the amplifier is disabled upon completion of the start-up phase;

d) said current mirror network comprising a plurality of transistors, whose gates are all connected together, wherein one terminal of each transistor of the current mirror network is connected to ground, wherein a first transistor of the current mirror network provides drive current for a comparison with the reference current generated by the third transistor of the current mirror circuit, wherein each of the other transistors of the current mirror network generates bias current;

e) said amplifier;

f) a trigger circuitry, which is configured to set a signal when a current comparator detects that the reference current is higher than the current generated by the first transistor of the current mirror network and, if it so, the first control switch is opened;

g) said first control switch configured to be open during start-up phase only;

h) a capacitor connected between the gate of the first transistor of the current mirror network and ground.

2. The power circuit of claim 1, wherein the current comparator is formed by the third transistor of the current mirror circuit and the first transistor of the current mirror network, and a Schmitt trigger.

3. The power circuit of claim 2, wherein the capacitor is a low pass filter formed from a MOS capacitor.

4. The power circuit of claim 2, further comprising an RS flip-flop circuit, wherein a first input of the RS flip-flop is connected to an output of the Schmitt trigger, a second input is connected to a disable signal, a first output opens the first control switch and a second output opens a second control switch which connects the output of the amplifier to the gates of the current mirror network.

5. The power circuit of claim 4, further comprising a first disable switch connected between the gate of the input driver transistor and ground, a second disable switch connected between the gates of the current mirror network and ground and a third disable switch connected between a node between drains of the third transistor of the current mirror circuit and a drain of the first transistor of said current mirror network and supply voltage, wherein all three disable switches are closed when the power switch is disabled.

6. The power circuit of claim 2, wherein said amplifier controls the voltage of the gates of the current mirror network to track a voltage of the gate of the input driver transistor, while both gate voltages are separated by the first control switch during start-up phase, and wherein both gate voltages are reconnected via the first control switch without any noticeable voltage difference when the start-up phase is completed.

7. A method of speeding-up a bias circuit, comprising:

a) forming a current mirror network comprising a plurality of current drivers, wherein a current mirror circuit provides a reference current and current to an input driver circuit supplying the current mirror network comprising a plurality of bias driver circuits, wherein the input circuit is connected via a first control switch to the current mirror network;

b) separating the current mirror network by the control switch from the input circuit by opening the control swithc during an start-up phase of the bias circuit and closing the control switch when the start-up phase is completed;

c) comparing by a current comparator circuit a current from a current driver of the current mirror network with a reference current in order to detect if the enablement phase is completed and initiating closing of the control switch; and d) implementing an amplifier configured to keep the gate voltage of the current mirror network at the same potential as the gate voltage of the input circuit while a control switch is open until the start-up phase is completed and then the control switch is closed and subsequently the amplifier is disabled to establish a direct gate connection between the input circuit and the current mirror network.

8. The method of claim 7, wherein said amplifier has a low output resistance to drive the capacitive load of the current mirror network.

9. The method of claim 7, wherein the reference current is generated by a transistor of the current mirror circuit.

10. The method of claim 9, wherein when the start-up phase is completed the amplifier is disconnected from the start-up circuit.

11. The method of claim 9, wherein said reference current is driver current of said current source.

12. The method of claim 9, wherein the current comparator circuit compares current from an output driver circuit of the second part of the current mirror network to a reference current from a driver circuit of a current source to determine when the current mirror network is at operating level.

13. The method of claim 12, wherein operating level is determined when current through the output driver circuit connected to the current mirror network is a same amplitude as the current from said driver circuit of the current source.

14. The method of claim 11, wherein an RS flip-flop is driven by the current comparator to disconnect the amplifier output from the current mirror network and rejoin the first and second parts of the current mirror network.

15. The method of claim 11, wherein the RS flip-flop is connected to an output of the current comparator circuit, wherein a switch disconnects the comparator circuit from the driver circuit of the current source upon completion of the start-up phase.

* * * * *